US010392852B1

(12) United States Patent
Mastrippolito

(10) Patent No.: US 10,392,852 B1
(45) Date of Patent: Aug. 27, 2019

(54) AUTOMATIC DOOR OPERATOR

(71) Applicant: Gentleman Door Automation LLC, Avondale, PA (US)

(72) Inventor: Louis T. Mastrippolito, Hockessin, DE (US)

( * ) Notice: Subject to any disclaimer, the term of this patent is extended or adjusted under 35 U.S.C. 154(b) by 0 days.

(21) Appl. No.: 15/361,363

(22) Filed: Nov. 25, 2016

Related U.S. Application Data

(60) Provisional application No. 62/260,241, filed on Nov. 25, 2015.

(51) Int. Cl.
*E05F 15/50* (2015.01)

(52) U.S. Cl.
CPC ..... *E05F 15/50* (2015.01)

(58) Field of Classification Search
CPC ..... E05F 15/56; E05F 15/57; E05F 15/50
See application file for complete search history.

(56) References Cited

U.S. PATENT DOCUMENTS 3,936,977 A * 2/1976 Runft ..... E05F 15/56 49/137
3,938,282 A 2/1976 Goyal
4,134,231 A 1/1979 Daugirdas et al.
4,272,923 A * 6/1981 Anderson ..... B60J 5/06 16/94 R
4,290,368 A 9/1981 Mazzini
4,476,678 A 10/1984 Hall
4,478,131 A 10/1984 Liermann et al.
4,523,513 A 6/1985 Gudat et al.
4,748,914 A * 6/1988 Cardinal ..... E05F 15/57 109/17
5,269,098 A * 12/1993 Redman ..... E05F 15/56 49/360
5,410,842 A * 5/1995 Watson ..... E05F 15/56 49/360
5,622,007 A 4/1997 Archer
5,791,087 A * 8/1998 Strab ..... E05F 15/56 49/360
5,878,530 A 3/1999 Eccleston
6,006,650 A * 12/1999 Adams ..... E05F 15/56 91/446
6,047,885 A * 4/2000 Fisher ..... E05F 15/57 220/200
6,065,184 A 5/2000 Drury
(Continued)

*Primary Examiner* — Catherine A Kelly
(74) *Attorney, Agent, or Firm* — Ramberg IP, LLC; Jeffrey R. Ramberg

(57) ABSTRACT

A door opening and closing operating system includes a pressurized fluid source (102), two fluid control push pull valves (144*a*), (144*b*), and a double acting cylinder (160) which is mounted to the movable element of a door (66) mounted within its adjacent frame (62) for the purpose of opening and closing the door. This system utilizes two push pull valves connected fluid-wise to opposite sides of the piston. Activating or energizing one push pull valve while deactivating the second push pull valve connects the first cylinder chamber to the pressurized fluid source, and vents the second chamber, thereby pushing the piston in a first direction, which pushes the door in a first direction. Energizing the second push pull valve and de-energizing the first push pull valve has the opposite effect, and moves the piston and attached door in a second direction opposite the first direction.

17 Claims, 6 Drawing Sheets

(56) References Cited

U.S. PATENT DOCUMENTS

| | | | | |
|---|---|---|---|---|
| 6,279,315 | B1 * | 8/2001 | Harju | F15B 11/048 60/410 |
| 7,543,410 | B2 | 6/2009 | Baczewski et al. | |
| 8,959,836 | B2 * | 2/2015 | Gayhart | E05B 65/0017 49/141 |
| 9,051,767 | B2 | 6/2015 | Nam | |
| 9,115,528 | B2 | 8/2015 | Hellbusch | |
| 9,334,684 | B2 | 5/2016 | Nam | |
| 2006/0119132 | A1 | 6/2006 | Rivers et al. | |

* cited by examiner

"AT REST"

"PRE-CHARGE"

"AS OPENING"

"AS CLOSING"

DOUBLE ACTING CYLINDER

AUTOMATIC DOOR OPERATOR

CROSS-REFERENCE TO RELATED APPLICATION

This patent document claims the benefit of U.S. Provisional Patent Application No. 62/260,241, filed on Nov. 25, 2015 in the name of Louis T. Mastrippolito. The entire contents of this commonly owned patent application are expressly incorporated herein by reference.

STATEMENT REGARDING FEDERALLY SPONSORED RESEARCH

None.

BACKGROUND OF THE INVENTION

1. Field of the Invention

The instant invention relates to an operating system that utilizes a regulated fluid, a power cylinder and a series of valves for the purpose of opening and closing swinging doors, sliding doors, gates, and windows in a safe and gentle manner.

2. Discussion of Related Art

Prior fluid powered operating systems that have been developed for controlling the movement of sliding doors and windows utilize electrical interface methods to operate control valves. This method substantially adds to the cost and complexity of these devices rendering this technology of little value as a means of retrofitting doors and windows commonly found in the typical residence or business. These known devices include a variety of electrical switches and sensors for the purpose of controlling movement, sensing location and permitting these units to operate in a safe manner.

Electro-mechanical systems have also been developed for a similar purpose. These units utilize an electric motor and mechanical means (a cable or chain for example) to provide movement and necessarily complex electrical sensors for control. As with prior fluid powered systems, the complexity and associated cost render these devices of little value in the home or office.

It is therefore desired from the standpoint of cost, ease of assembly and operation, safety, number of parts, and reliability, an operating system that is suitable for retrofitting existing doors and windows, easy to install, easy to relocate, is inexpensive, reliable, compact, quiet, and inherently safe in operation.

U.S. Pat. No. 5,791,087 to Thomas J. Strab is relevant to the present invention, and as such, is incorporated herein by reference in its entirety.

SUMMARY OF THE INVENTION

In accordance with embodiments of the instant invention, a door opening and closing operating system includes a pressurized fluid source (102), two fluid control push pull valves (144*a*), (144*b*), and a double acting cylinder (160) that is mounted to the movable element of a door (166) mounted within its adjacent frame (168) for the purpose of opening and closing the door. This system utilizes two push pull valves connected fluid-wise to opposite sides of the piston. Activating or energizing one push pull valve while deactivating the second push pull valve connects the first cylinder chamber to the pressurized fluid source, and vents the second chamber, thereby pushing the piston in a first direction, which pushes the door in a first direction. Energizing the second push pull valve and de-energizing the first push pull valve has the opposite effect, and moves the piston and attached door in a second direction opposite the first direction.

The system is useful for persons with physical disabilities.

DETAILED DESCRIPTION OF EMBODIMENTS OF THE INVENTION

Figure 1:
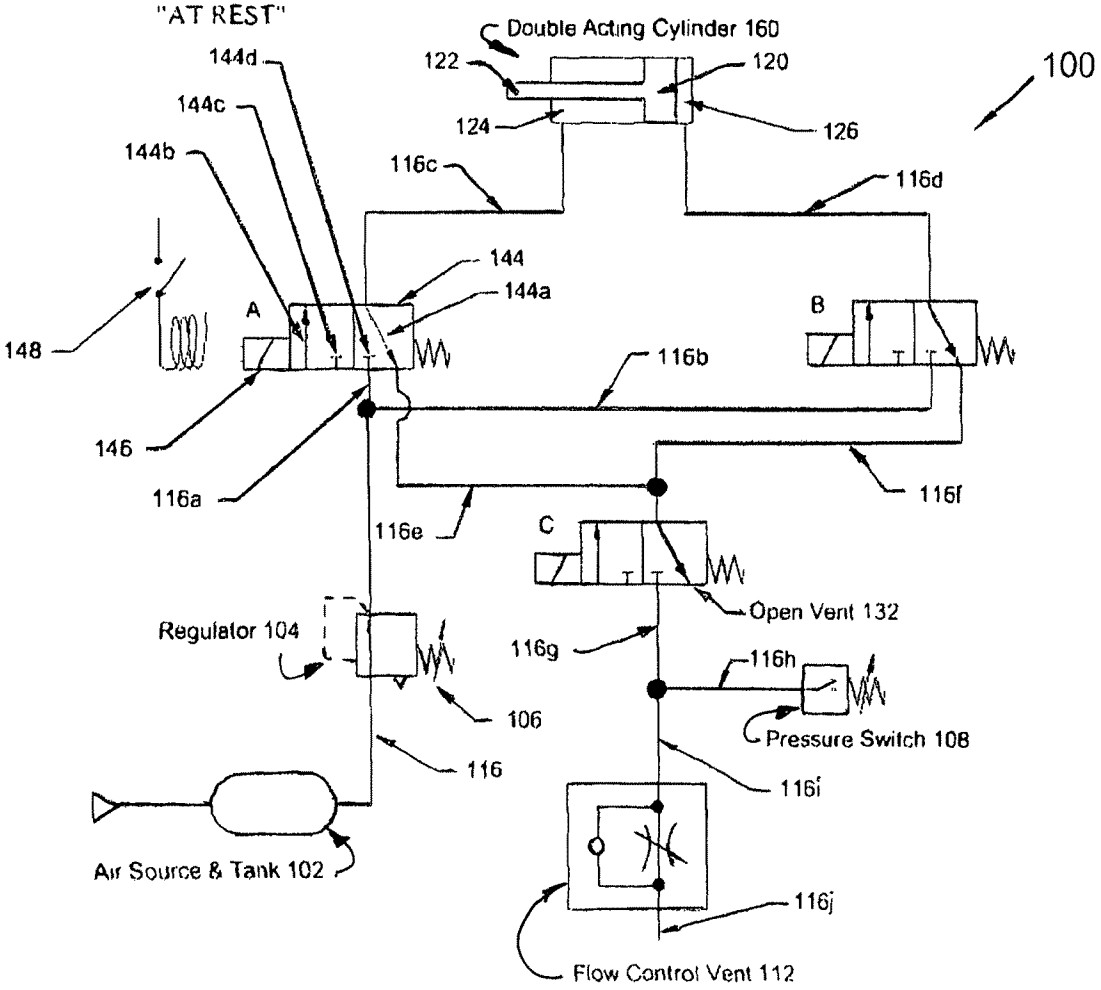
FIG. 1 is a schematic diagram of the system of the present invention "at rest".

Embodiments of the invention will now be described with reference to the figures, where like numbers identify and describe like parts.

Referring to the above described FIGS. 1 through 4, the basic door operating system 100 includes a pressurized fluid tank 102; a pressure regulator 104 with an adjusting knob 106; pressure switch 108, flow control vent 112, a set of valves A, B and C; and tubing 116 with tubing sections 116*a* through 116*j* for conducting the pressurized fluid. Additionally, a fluid pressure operated double acting cylinder 160 features piston 120, connecting rod 122, left cylinder chamber 124, and right cylinder chamber 126. The double acting cylinder 160 is securely mounted to a frame 168, and connecting rod 122 is securely mounted to a door 166 that is configured to move relative to frame 168. The term "door" is used in this document in a generic sense, and includes gates and windows, whether mounted on hinges or configured to slide in a track.

Valve A, which may be termed a "push-pull" valve, features a spool member 144 having channels 144*a*, 144*b* and caps 144*c* and 144*d*. Spool 144 is operatively connected to a solenoid 146 that is capable of displacing the spool 144 upon activation of electrical switch 148. This device is commonly referred to as a solenoid valve. Valves B and C are similar. Valve A is operatively connected to tubing sections 116*a*, 116*c* and 116*e*.

Valve A is fluidly connected to left chamber 124 of double acting cylinder 160. Valve B is fluidly connected to right chamber 126, which is opposite piston 120 from left chamber 124.

Piston 120 may be moved in either direction using pressurized fluid. For example, to move piston 120 to the right, left chamber 124 is pressurized. Since it is possible, for reasons that will be discussed in more detail below, right chamber 126 may already be pressurized, and since both chambers are pressurized from the same source of pressurized fluid, if the piston is to be moved to the right, then right chamber needs to be vented, and vice-versa. There are two ways to accomplish the venting.

By the first venting method, venting is through flow control vent 112, to atmosphere. This venting is termed "metered venting", occurs relatively slowly, and is controllable or adjustable. By the other venting method, venting is also to atmosphere, but, takes place through open vent 132, and is controlled by push-pull valve C. This venting is much more rapid than that through flow control vent 112. The reasons for providing mechanisms for both fast and slow venting will be discussed in more detail below.

Pressure switch 108 is in fluid communication with tubing sections 116*g*, 116*h* and 116*i*.

Operation of the Basic System

FIG. 1 illustrates the "at rest" condition. At rest, all solenoids are de-energized and both chambers 124, 126 in the cylinder 160 vent to atmosphere through Open Vent 132, which is connected to solenoid valve C. Specifically, left chamber 124 vents through tube 116*c*, which is connected to tube 116*e* at solenoid valve A. Tube 116*e* connects to solenoid valve C. Similarly, right chamber 126 vents through tube 116*d*, which connects to tube 116*f* at solenoid valve B, and tube 116*f* connects to solenoid valve C. If attached to a swinging door or sliding door, no resistance would be felt from manual door operation. Thus, the door would feel and behave like an ordinary non-powered door.

Figure 2:
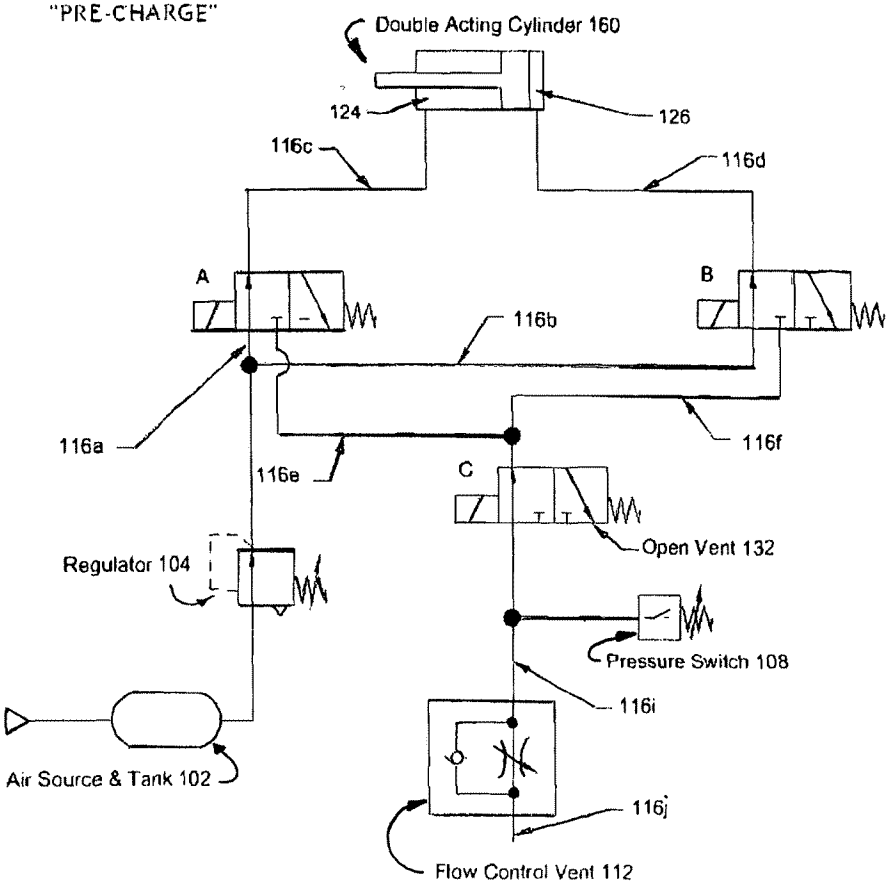
FIG. 2 is a schematic diagram of the system of the present invention "pre-charge".

FIG. 2 illustrates the system when it is first energized but before the door is moved under pneumatic power. Upon activating, solenoid valves A and B are energized for a very short time to direct regulated air pressure to "pre-charge" each side of the cylinder 160, that is, to pre-charge left chamber 124 and right chamber 126. This pre-charge provides a base signal for the vent pressure needed in step 4; otherwise the piston would need to travel a significant distance before producing a useable signal. Specifically, the energizing of solenoid valves A and B shifts spool member 144 so that tube 116*a* is connected to tube 116*c* at solenoid valve A, and tube 116*e* is disconnected from tube 116*c*. A similar change occurs with the energizing of solenoid valve B: pressurized fluid is placed into communication (connected) with right chamber 126, and tube 116*f* is disconnected.

Solenoid valve C is energized to direct the vented air from solenoid valve A or B (respectively) to the pressure switch 108 and the flow control vent 112 instead of directing the vented air to open vent 132.

Figure 3:
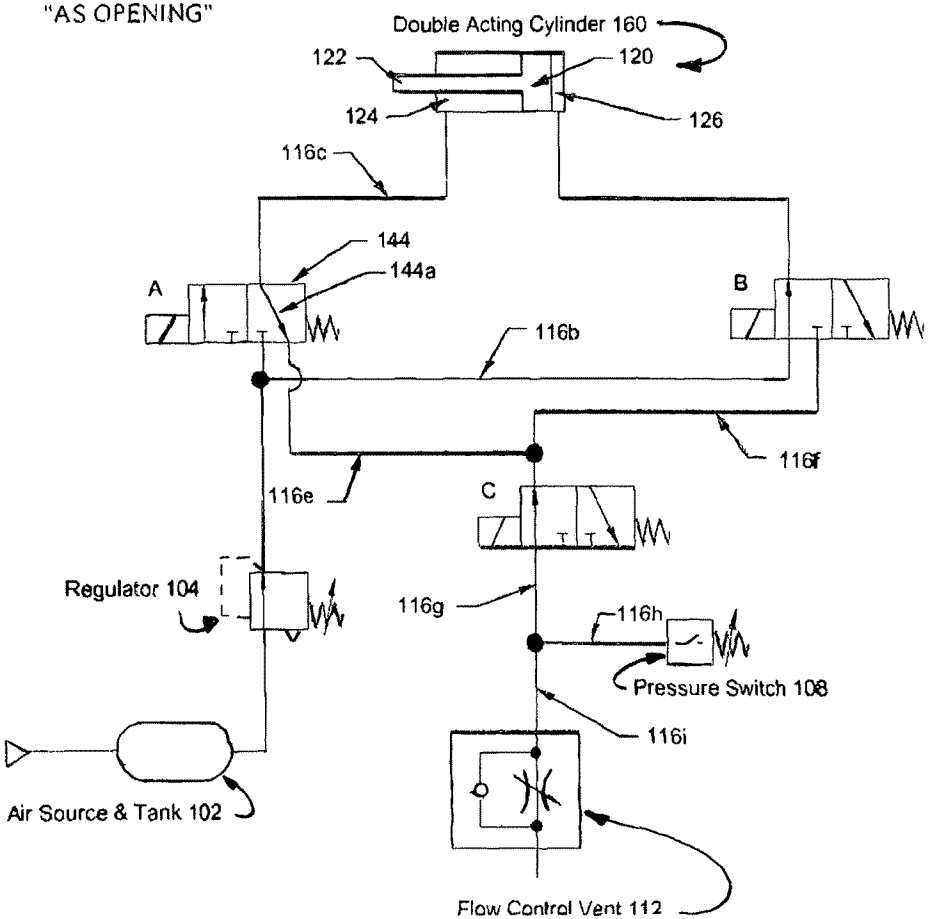
FIG. 3 is a schematic diagram of the system of the present invention in door opening mode.

FIG. 3 illustrates the state of the system as it is opening the door: Solenoid valves B and C remain energized and solenoid valve A is de-energized. Solenoid valve B continues to allow regulated air pressure to enter the right chamber 126 of cylinder 160. With solenoid valve A de-energized, spool member 144 returns to its original position in the "at rest" condition. Thus, left side chamber 124 is disconnected from the pressurized fluid source, and instead is vented; that is, it is connected to flow control vent 112 through solenoid valve C. More exactly, pressurized fluid in left chamber 124 vents through tube 116*c*, which is connected to tube 116*e* via solenoid valve A, and connected to tube 116*g* via solenoid valve C. and connected to tube 116*i* which is connected to flow control vent 112. Thus, right chamber 126 is pressurized while left chamber 124 is vented. This pressure imbalance forces piston 120 to the left, resulting in powered movement of connecting rod 122 to the left, which is connected to the door.

Figure 6:
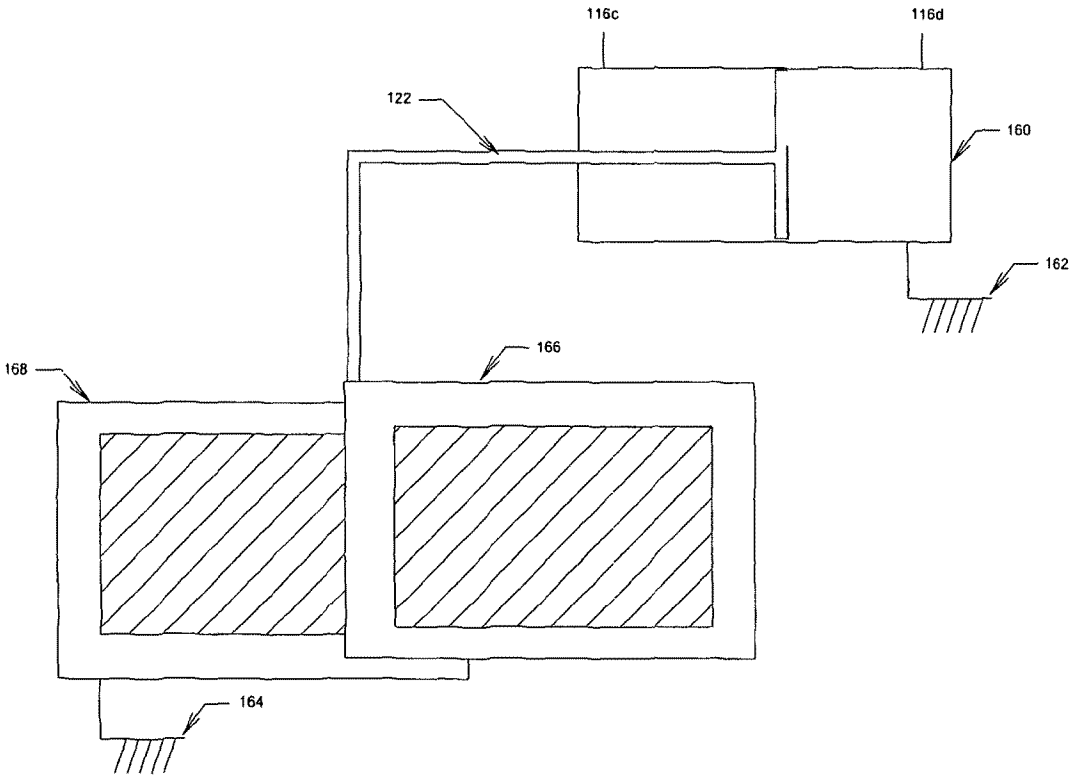
FIG. 6 is a side view of the system showing how double acting cylinder 160 opens and closes a sliding door.

The opening of the door 166 is best seen with reference to FIG. 6. The chassis or housing of double acting cylinder 160 is mounted to a fixed structure at mount 162. Similarly, mount 164 indicates that frame 168 is fixed. Door 166 is attached to connecting rod 122, and is free to move left or right relative to frame 168 in response to motion of connecting rod 122 left or right.

Figure 4:
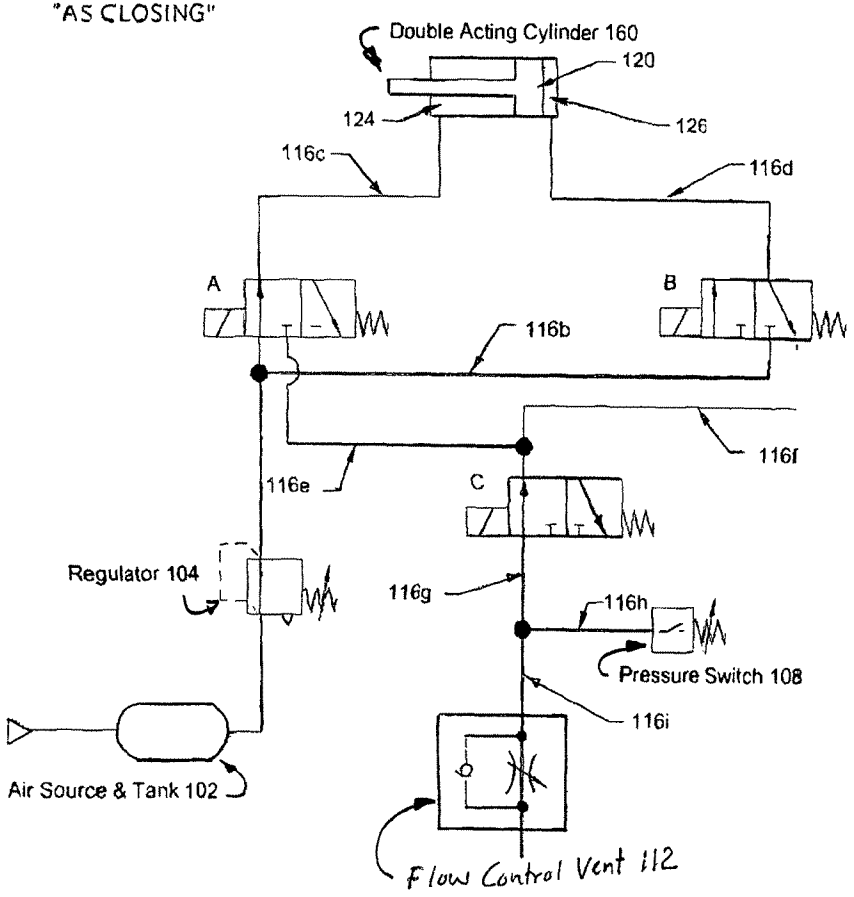
FIG. 4 is a schematic diagram of the system of the present invention in door closing mode.

To close the door, the system is first pre-pressurized as in FIG. 2. Then, solenoid valves A and C are energized, and solenoid valve B is de-energized. FIG. 4 illustrates this state of the system as it is closing the door: Solenoid valve A continues to allow regulated air pressure to enter the left chamber 124 of cylinder 160. With solenoid valve B de-energized, its spool member returns to its original position in the "at rest" condition. Thus, right side chamber 126 is disconnected from the pressurized fluid source, and instead is vented; that is, it is connected to flow control vent 112 through solenoid valve C. More exactly, pressurized fluid in right chamber 126 vents through tube 116*d*, which is connected to tube 116*f* via solenoid valve B, and connected to tube 116*g* via solenoid valve C. and connected to tube 116*i* which is connected to flow control vent 112. Thus, left chamber 124 is pressurized while right chamber 126 is vented. This pressure imbalance forces piston 120 to the right, resulting in powered movement of connecting rod 122 to the right, thereby, closing the door.

As long as pressure switch 108 remains pressurized, the switch remains closed, and any energized solenoids remain energized. The pressure switch 108 opens when pressure in line 116*h* falls below some minimum threshold. This de-energizes all solenoid valves, essentially returning them to the FIG. 1 "at rest" condition. This means that all solenoid valves are vented. This means that there is no pressure above ambient on either side of piston 120, and thus the door can be opened and closed manually without the resistance of air pressure.

In effect, pressure switch 108 detects door movement by monitoring vent pressure and acts as a safety device in both directions of movement. During normal operation, when the moving door reaches its "full open" or "fully closed" position and stops, pressure switch 108 opens and de-energizes all solenoids, which completely de-pressurizes the system. An example of an abnormal condition is when the moving door encounters an obstacle. In this case, the premature stopping of the door again opens pressure switch 108, de-energizing all solenoids, which completely de-pressurizes the system, thereby eliminating the pneumatic pressing force on the door.

The flow control vent bleeds off air pressure from the non-working side of the piston. It performs this function relatively slowly while controlling the piston movement and maintaining differential pressure in both piston chambers. This allows the pressure to remain above the threshold pressure until the piston's movement is almost to one side of the cylinder or the other. In turn, this allows the pressure switch to remain closed during this time, which keeps all energized solenoids energized during this time, thereby permitting the door to open or close fully.

One may wonder why there is a need for solenoid valve C. After all, why does it need an "open vent" 132 when pressure can bleed off through flow control vent 112? The answer is that open vent 132 "dumps" the pressurized air much more quickly than flow control vent 112. This quick response is useful for quickly dissipating the air pressure in the system, and thus the force on the door, for example, when the door encounters an obstacle and cannot open or close all the way.

Again, should the piston stop movement or reach the end of its stroke, the vent pressure will fall below minimum pressure as the flow control vent 112 allows air to vent. The pressure switch 108 releases the electrical connection, which releases all solenoids, venting both piston chambers quickly to atmosphere and stopping all movement.

More Advanced Features of the System

The system can be designed to operate manually, for example, using push-button type on-off switches and a series of relays. Another approach is to use a programmable logic controller (PLC) to supervise the control of the solenoid valves. The PLC can respond to inputted commands, such as the pressing of on-off buttons for "door open", "door close", etc. The on-off button that is pressed does not have to be physically connected to the PLC, but instead can be a wireless connection ("remote control"), such as infrared or a short-range radio transmitter, including Wi-Fi.

Figure 5:
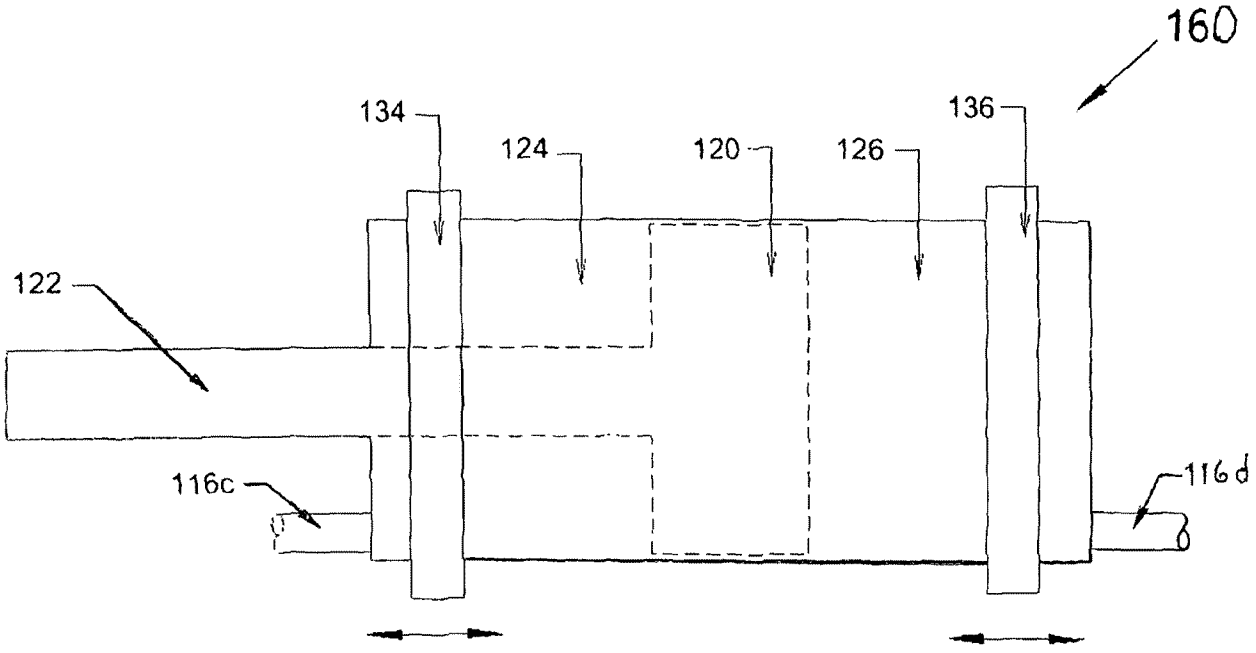
FIG. 5 is a side view of double acting cylinder 160 showing the "open" and "close" magnetic switches.

Another feature of the PLC embodiment is that the system may incorporate sensors such as reed or magnetic switches to indicate to the PLC the last known position of the cylinder (and thus the last known position of the door). In particular, and referring to FIG. 5, what is shown is a side view of double acting cylinder 160 featuring a pair of adjustable reed or magnetic switches 134 and 136. If piston 120 is made of metal, and particularly of a magnetic metal, the magnetic switches in the form of rings extending around the outside of cylinder 160, can sense when piston 120 moves past them, and send an electrical signal, for example, in the form of a pulse of electricity, to the PLC. Thus magnetic switch 136 may be identified as the "closed" switch, telling the PLC when the door is in the closed position. Similarly, magnetic switch 134 may be identified as the "open" switch, telling the PLC that the door is in the open position.

Again, magnetic switches 134 and 136 are adjustable. Here, each may be moved or re-positioned along cylinder 160. This can give rise to another aspect of the instant invention, where the signal from a magnetic switch is used to de-energize solenoid valve C.

More particularly, if this "closed" magnetic switch 136 is slid further away (inward) from a fully closed position, it will enable a feature to use the door's mass to increase closing force to latch the door. This is required when stack pressure or weatherstrip creates a resistance not allowing the door to fully close.

As the door is closing and the piston reaches the "closed" magnetic switch 136, the signal from switch 136 not only tells the PLC that the door is closed, or almost so, it also de-energizes solenoid valve C, allowing an unrestricted vent through open vent 132. This then leads to a large pressure imbalance, since solenoid valve A is still energized and thus allowing pressurized air into left chamber 124. However, this pressure imbalance is fleeting or temporary, as the dissipation of air pressure "downstream" of solenoid valve C, namely, in lines 116*g*, 116*h*, 116*i* and 116*j* causes pressure switch 108 to open, which de-energizes all solenoids, causing left chamber 124 to vent as well. Thus, the overall effect is that of one final pressure "pulse" helping to finish closing the door. The power pulse creates inertia in the door to create the force needed to fully close the door. The greater the door's weight, the better the effect. This process is very much like a person throwing a door shut as opposed to pushing it completely closed.

The reverse effect can be designed into the system during the opening event, as described next.

During opening of the door, not only can "open" magnetic switch 134 send a signal to the PLC that the door is open, this signal can also be used to de-energize solenoid valves B and C. Since solenoid valve A is already-de-energized, venting left chamber 124, this action also causes right chamber 126 to vent as well. Since the entire system is venting through open vent 132, the venting is rapid. Since the door is moving and has mass, it therefore has momentum or inertia. Thus, the door does not have to be fully open before the system-wide venting occurs; the door's inertia will carry it to the full open position. More significantly, this permits a "soft" opening rather than pressure (and thus power) being applied all the way until the door is fully open. This "soft finish" feature is accomplished by positioning reed switch 134 inward from its "fully open" position on cylinder 160. In other words, this will cause the system to end its power open cycle earlier to reach the desired effect. This feature is useful where a heavy door is swinging into a door stop or wall.

Again, the magnetic switches 134 and 136 signal to the PLC the last known position of the piston, and thus of the door. If the system has an "automatic" mode and is placed in this mode, when the system is next energized or the next command is given to change the door's status, the PLC will "remember" the last known position of the door, and act accordingly. For example, if the PLC remembers that the last known position of the door was open, and is then given a command to change the door's status, it will attempt to close the door by initiating the "door close" procedure.

Both magnetic switches also allow the PLC to track the door position when the door is being opened and closed manually. Should the automatic feature be activated, the last known position will influence whether the door will open or close automatically.

The compressed fluid for the system may be compressed gas that is commonly available for sale in specially designed cylinders, such as carbon dioxide, nitrogen, oxygen or air, for example. Alternatively, the system may provide a compressor for compressing air.

SUMMARY AND CONCLUSIONS

If the non-working side of the piston continues to move and maintains vent pressure to hold the pressure switch while the flow control vent is venting, the PLC both will continue to allow regulated pressure to be sent to the working side of the piston, and allow venting of the non-working side of the piston and movement continues. If the piston fails to move at a rate to maintain minimum pressure to the pressure switch as the flow control vent allows air to vent, the pressure switch releases and sends a signal to the PLC to release all solenoid valves and piston movement stops.

Through a pneumatic circuit and PLC, the pneumatic cylinder movement is controlled smoothly with differential pressure. Monitoring the vent pressure of the non-working side of the piston allows a signal to indicate actual piston movement. The signal can be used to detect if the working pneumatic cylinder has reached an obstruction or its limits in either direction. This signal allows a PLC to react and release the cylinder if movement stops. This pneumatic circuit and PLC system, when integrated to automate a door, allows a level of safety in both directions to stop when an obstructions is met.

The present embodiments of the invention provide an operating system that is gentle in its movement and otherwise safe to use.

The present embodiments of the invention also provide a door operating system suitable for retro-fitting existing doors, that is easy to relocate, and can be utilized in an equal capacity with new construction of dwellings and places of business.

Furthermore, the present embodiments of the invention provide a door operating system that does not substantially interfere with the normal manual operation of the door.

Moreover, and in contrast with one pneumatic door control of the prior art, the present inventive embodiments do not utilize a differential pressure switch to open or close an electrical circuit in response to a pressure difference exceeding a threshold value. Also, the present inventive embodiments may use a latching mechanism to hold the door closed, rather than with pneumatic pressure. Also, in some prior art systems, limit switches to detect the fully open or fully closed position, are required for operation of the door. In contrast, such switches are not required in the present inventive embodiments, but instead are optional features. Another contrast with some prior art systems is that the present inventive embodiments use the lack of pressure rather than excessive pressure (detected, for example, via a differential pressure switch) to detect obstacles upon closing of the door.

In addition, sliding patio doors, pocket doors, sliding windows, and double hung windows are non-limiting examples of application areas for the present embodiments of the invention. The advanced features of the present invention may not apply in all cases.

Other application areas of the present embodiments of the invention include doors for trains, buses, and elevators, although the pre-charge timing, pressures, and vent settings may need to be customized for each device to meet operation and safety goals.

Still further, the system of the present invention could be used to move most any object, provided that (i) the object naturally comes to a halt when the pressure or force applied by the system is released, and (ii) the object does not require pressure or force to be held in place.

An artisan of ordinary skill will appreciate that various modifications may be made to the invention herein described without departing from the scope or spirit of the invention as defined in the appended claims.

What is claimed is:

1. A door operating apparatus comprising:

(a) a door mounted in a framed opening;

(b) a fluid pressure activated cylinder having an axially disposed piston coupled to the door so that the axial piston having a displacement which causes opening or closing movement of the door relative to the frame; the cylinder defining first and second cylinder chambers therein on opposite sides of the piston;

(c) a first push-pull valve having (i) a fluid inlet port in communication with a source of pressurized fluid;

(ii) a fluid outlet port in communication with the first cylinder chamber;

(iii) a fluid pressure relief port; and (iv) a displaceable spool member that is in a first position, thereby connecting the outlet port to the inlet port while sealing the relief port when the first push-pull valve is activated, and the spool member being in a second position, thereby connecting the outlet port to the relief port while sealing the inlet port when the first push-pull valve is deactivated;

(d) a second push-pull valve having (i) a fluid inlet port in communication with a source of pressurized fluid;

(ii) a fluid outlet port in communication with the second cylinder chamber;

(iii) a fluid pressure relief port; and (iv) a displaceable spool member that is in a first position, thereby connecting the outlet port to the inlet port while sealing the relief port when the second push-pull valve is activated, and said spool member being in a second position, thereby connecting the outlet port to the relief port while sealing the inlet port when the second push-pull valve is deactivated;

(e) a third push-pull valve having (i) a fluid inlet port in communication with said fluid pressure relief port of said first and second push-pull valves;

(ii) a fluid outlet port;

(iii) a vent port to atmosphere; and (iv) a displaceable spool member that is in a first position when said third push-pull valve is activated, thereby for connecting the fluid outlet port to the fluid inlet port while sealing the vent port, and said spool member being in a second position when said third push-pull valve is deactivated, thereby connecting the fluid inlet port to the vent port;

(f) a flow control vent valve connected by a transfer line to the fluid outlet port of the third push-pull valve, the flow control vent valve being adapted to exhaust fluid to atmosphere at an adjustable rate; and (g) a pressure switch in fluid communication with the transfer line, and configured to maintain push-pull valves that are energized in an energized state at a pressure above a preselected threshold pressure, and further configured to de-energize all of said three push-pull valves at a pressure below said preselected threshold pressure.

2. The door operating apparatus of claim 1 wherein the first push-pull valve is an electrically operated solenoid valve.

3. The door operating apparatus of claim 2 wherein the first push-pull valve further includes means for activating by a remote transmitter.

4. The door operating apparatus of claim 1 wherein the door is a gate.

5. The door operating apparatus of claim 1 wherein the cylinder is mounted vertically and the door is a window.

6. The door operating apparatus of claim 1, wherein said axial piston comprises a magnetic material.

7. The door operating apparatus of claim 6, further comprising a first sensor mounted on said fluid pressure activated cylinder near an end of said cylinder corresponding to a fully closed position of the door.

8. The door operating apparatus of claim 6, further comprising a second sensor mounted on said fluid pressure activated cylinder near an end of said cylinder corresponding to a fully open position of the door.

9. The door operating apparatus of claim 7, wherein said first sensor transmits an electrical signal when said magnetic piston passes by, and said electrical signal is used to deactivate at least one of said first, second and third push-pull valves.

10. The door operating apparatus of claim 9, wherein said electrical signal is used to deactivate said third push-pull valve.

11. The door operating apparatus of claim 8, wherein said second sensor transmits an electrical signal when said magnetic piston passes by, and said electrical signal is used to deactivate said second and third push-pull valves.

12. A method for operating a door comprising the steps of:

(A) providing a door operating apparatus comprising:

(a) a door mounted in a framed opening;

(b) a fluid pressure activated cylinder having an axially disposed piston coupled to the door so that the axial piston having a displacement which causes opening or closing movement of the gate relative to the frame; the cylinder defining first and second cylinder chambers therein on opposite sides of the piston;

(c) a first push-pull valve having (i) a fluid inlet port in communication with a source of pressurized fluid;

(ii) a fluid outlet port in communication with the first cylinder chamber;

(iii) a fluid pressure relief port; and;

(iv) a displaceable spool member that is in a first position, thereby connecting the outlet port to the inlet port while sealing the relief port when the first pushpull valve is activated, and the spool member being in a second position, thereby connecting the outlet port to the relief port while sealing the inlet port when the first push-pull valve is deactivated;

(d) a second push pull valve having (i) a fluid inlet port in communication with a source of pressurized fluid;

(ii) a fluid outlet port in communication with the second cylinder chamber;

(iii) a fluid pressure relief port; and (iv) a displaceable spool member that is in a first position, thereby connecting the outlet port to the inlet port while sealing the relief port when the second push-pull valve is activated, and said spool member being in a second position, thereby connecting the outlet port to the relief port while sealing the inlet port when the second push-pull valve is deactivated;

(e) a third push-pull valve having (i) a fluid inlet port in communication with said fluid pressure relief port of said first and second push-pull valves;

(ii) a fluid outlet port;

(iii) a vent port to atmosphere; and (iv) a displaceable spool member that is in a first position when said third push-pull valve is activated, thereby for connecting the fluid outlet port to the fluid inlet port while sealing the vent port, and said spool member being in a second position when said third push-pull valve is deactivated, thereby connecting the fluid inlet port to the vent port;

(f) a flow control vent valve connected by a transfer line to the fluid outlet port of the third push-pull valve, the flow control vent valve being adapted to exhaust fluid to atmosphere at an adjustable rate; and (g) a pressure switch in fluid communication with the transfer line, and configured to maintain push-pull valves that are energized in an energized state at a pressure above a preselected threshold pressure, and further configured to de-energize all of said three push-pull valves at a pressure below said preselected threshold pressure; and (B) while the second push-pull valve is inactive, activating the first push-pull valve, thereby admitting pressurized fluid through the first push-pull valve into the first cylinder chamber and venting compressing fluid in the second cylinder chamber to vent to atmosphere through the vent port of the flow control vent valve to cause the gate to move in a first direction relative to the frame.

13. The method of claim 12 further comprising the steps of:

(C) activating the second push-pull valve, thereby admitting pressurized fluid through the second push-pull valve into the second cylinder chamber; and (D) deactivating the first push-pull valve, thereby venting the fluid in the first cylinder chamber through the first push-pull valve and the flow control vent valve to atmosphere, thereby causing the door to move in a second direction opposite the first direction.

14. The method of claim 12, wherein the fluid that is venting is vented at a sufficiently low flow rate effective to maintain fluid in the pressure switch at a decreasing pressure above the preselected threshold pressure, thereby maintaining activated or energized push-pull valves in an energized state.

15. The method of claim 14, wherein when said decreasing pressure drops below the preselected threshold pressure, the pressure switch de-energizes or deactivates any energized push-pull valves.

16. The method of claim 12 wherein the first push-pull valve is an electrically operated solenoid valve and is activated by a remote transmitter.

17. The method of claim 13, wherein the fluid that is venting is vented at a flow rate effective to maintain fluid in the pressure switch at a decreasing pressure above the preselected threshold pressure, thereby maintaining activated or energized push-pull valves in an energized state.

* * * * *